United States Patent [19]

Dammert et al.

[11] 4,340,876

[45] Jul. 20, 1982

[54] MAGNETIC ARMATURE MOUNTING IN PARTICULAR FOR MINICOMPACT RELAYS

[76] Inventors: Wolfgang Dammert, Ludwigstrasse 46; Horst Enge, Friedrichstrasse 27, both of D 8672 Selb, Fed. Rep. of Germany; Jacques Dufour, La Fouiniere Saint Sauveur, F 86100 Chatellerault, France

[21] Appl. No.: 140,873

[22] Filed: Apr. 16, 1980

[30] Foreign Application Priority Data

Apr. 18, 1979 [DE] Fed. Rep. of Germany ..... 2915661
Nov. 21, 1979 [DE] Fed. Rep. of Germany ..... 2946881

[51] Int. Cl.[3] ..... H01F 7/14

[52] U.S. Cl. ..... 335/276; 335/274; 335/203

[58] Field of Search ..... 335/276, 274, 128, 202, 335/203, 194

[56] References Cited

U.S. PATENT DOCUMENTS 4,045,755 8/1977 Schroëder et al. ..... 335/276 X
4,267,540 5/1981 Iketani ..... 335/128

FOREIGN PATENT DOCUMENTS 1163270 9/1958 France ..... 335/276
287100 10/1928 United Kingdom ..... 335/276

*Primary Examiner*—L. T. Hix
*Assistant Examiner*—S. D. Schreyer
*Attorney, Agent, or Firm*—Bacon & Thomas

[57] ABSTRACT

A mounting for a magnetic armature intended particularly for minicompact relays and provided with a housing encasing a magnetic coil, a magnetic armature and a spring is angled and held tiltably against the magnetic yoke by means of its spring force. The spring force is applied to the yoke by the flat spring strip freely inserted into the housing of the relay, which for this purpose is supported under prestress with its front side ends abutting the walls of the housing or with one end abutting the wall and with the other end abutting the switch spring or the switch spring and a switch spring support and/or contact and a contact spring support, while abutting, at its bend on the magnetic armature.

9 Claims, 6 Drawing Figures

Fig. 1
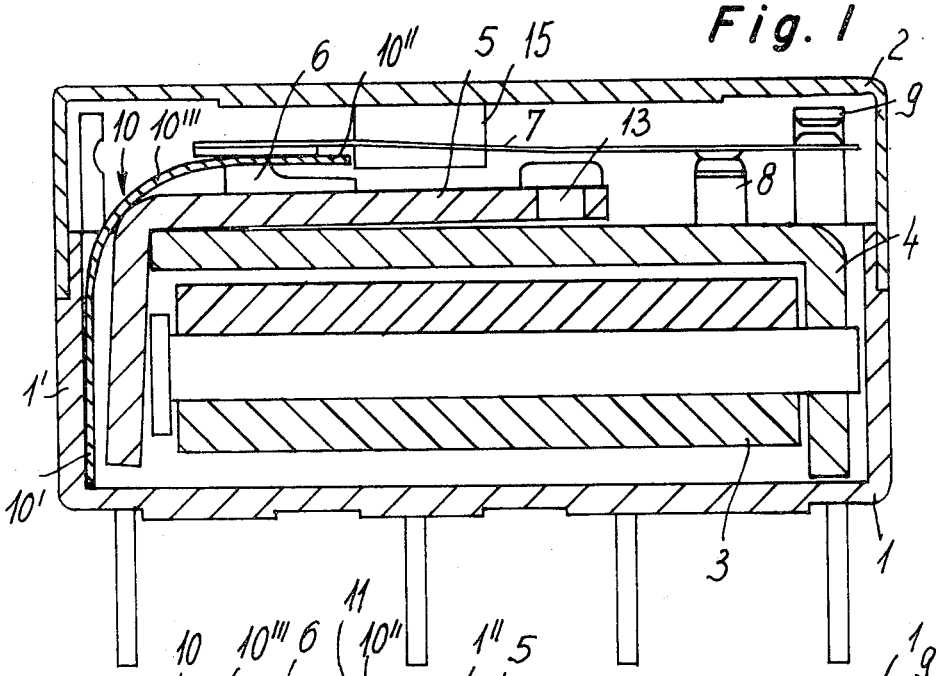
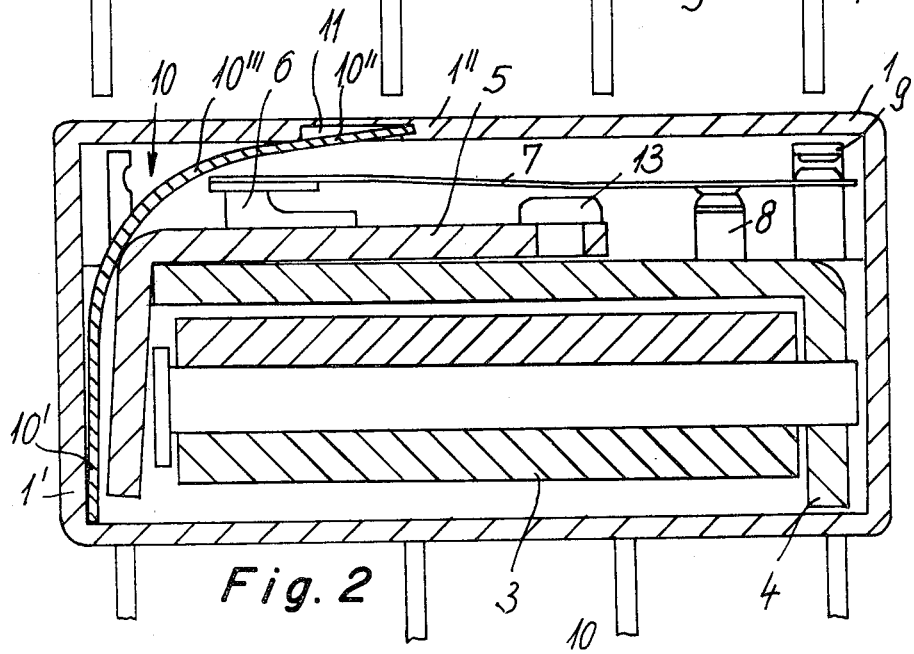
Fig. 2
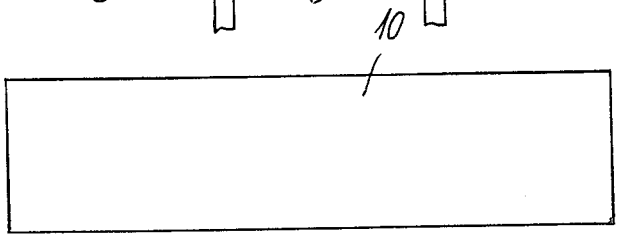
Fig. 3

Fig. 5
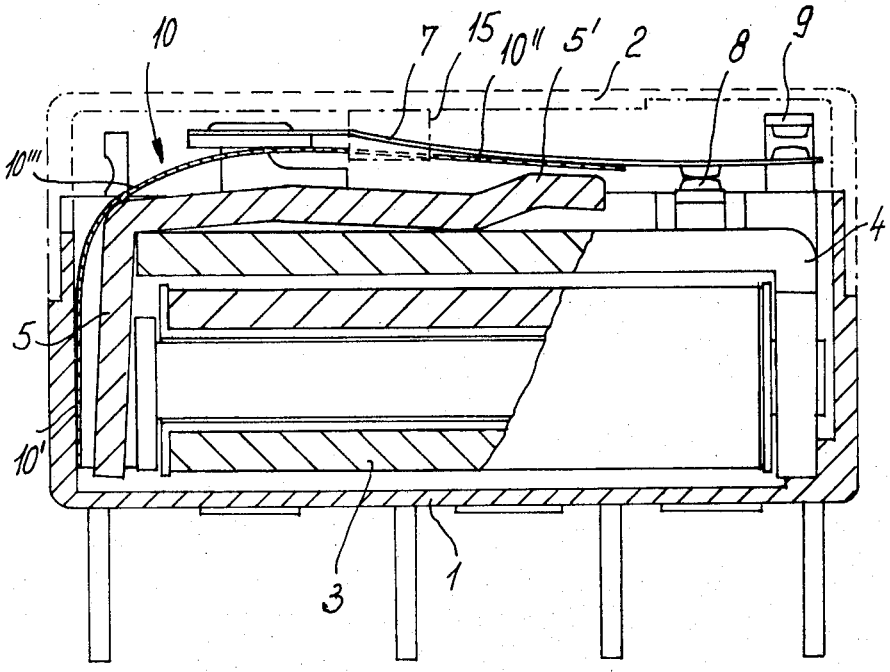
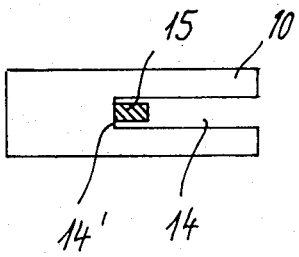
Fig. 6

MAGNETIC ARMATURE MOUNTING IN PARTICULAR FOR MINICOMPACT RELAYS

BACKGROUND OF THE INVENTION

The invention concerns a mounting for magnetic armatures, particularly for minicompact relays with a housing comprising the magnetic coil with the magnetic yoke, the magnetic armature and the spring bank, wherein the magnetic armature is angled and held tiltably at the magnetic yoke by the force of a spring.

In known relays, a magnetic armature is held against a magnetic yoke by means of flat metal springs. The flat springs are fixedly connected with the magnetic armature and/or the magnetic yoke. It is also known to hold the magnetic armature on the armature bearing by means of helical springs supported by their ends facing away from the armature on the housing. Aside from the fact that the holding springs of the known relays require a substantial effort for their assembly, they cannot satisfy the condition of reduced size relays, because of the need to observe electrical distances between conducting parts. Furthermore, the known holding springs have an interfering torque effect on the magnetic armature.

SUMMARY OF THE INVENTION

It is an object of this invention to provide an armature mounting which is simple in design and capable of holding the magnetic anchor on the armature mounting free of torque.

The object is attained according to the invention by means of a bent, flat spring strip, freely insertable, supported under prestress with its front ends on the walls of the housing or on a wall, respectively and on a switching or contact spring holder, and abutting with its bending apex against the armature. Preferably, the spring strip is made of an elastic synthetic material, for example, a section of a sheet. It is within the scope of the invention to make the strip of another material, for example, a metal. With the armature mounting created in this manner, only a simple process of insertion is needed for the spring strip, whereby the magnetic armature remains safely free of torque by virtue of the pressing contact of the bending apex by way of a hinge.

Axial immobilization of the spring strip was found to be appropriate in the design of the magnetic armature mounting. For this purpose, the spring strip may be guided by one or both ends in a slit of the housing wall, or it may be supported on shoulders, projections or the like, of the walls of the housing.

Simple axial fixation of the spring strip in relays with a housing closable by means of a cover may also be obtained by supporting the spring strip, for example, with one end of the wall of the housing and with the other end on a shoulder integral with the cover, or the like. In relays with a plurality of the contact springs arranged adjacent to each other, the integral projection of the cover may protrude between the contact springs and into the housing.

According to a preferred embodiment of the magnetic armature mounting, the spring strip is supported at one of its ends on a wall of the housing and at the other end on the contact spring or the contact spring and its holder and/or a switch spring or its holder, respectively, while the bending apex holds the magnetic armature against the magnetic yoke with prestressing. The spring strip thus provides, in addition to its holding function in relation to the magnetic armature, an electric separation of the magnetic armature and the switch spring by means of its insulating properties.

A further feature is to let the spring strip with its end facing the switch spring protrude into the path of rotation of the magnetic armature, thus effecting the actuation of the switch spring by means of the magnetic armature, directly or indirectly through the action of a tappet. In this manner it may be possible to eliminate the actuating tappet bridging the galvanic insulation between the magnetic armature and the switch spring.

In a further development of the concept of the invention, the spring strip may be secured in the relay housing by providing a slit or recess in the end of the spring strip facing the switch springs and supporting the spring strip with the surfaces outlining the slit or recess on a shoulder arranged, for example, on the cover or the like, of the relay housing. In minicompact relays with at least two switch springs. The slit or recess is approximately provided in the area between the switch springs.

BRIEF DESCRIPTION OF THE DRAWINGS

FIG. 1 is a relay in cross section with a magnetic armature mounting;

FIG. 2 is a relay in cross section with a magnetic armature mounting of modified design;

FIG. 3 is a top ivew of a spring strip;

FIG. 5, is a sectional view of a relay showing another mounting for the magnetic armature; and FIG. 6 is a top view of a spring strip, reduced to scale.

DESCRIPTION OF THE PREFERRED EMBODIMENTS

Figure 4:
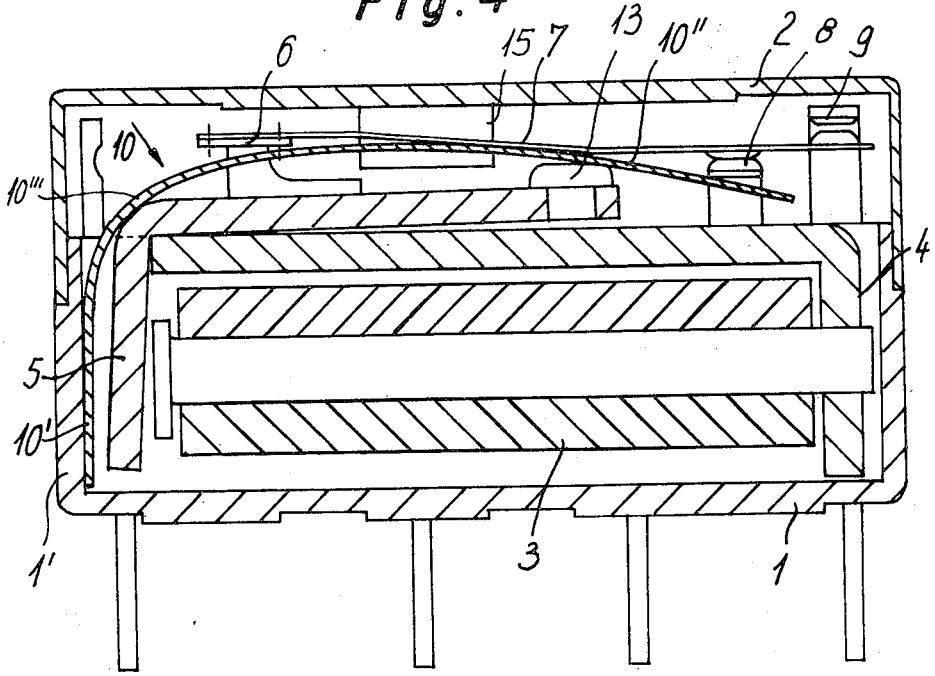
FIG. 4 is a sectional view of a relay with a magnetic armature mounting according to another embodiment.

In FIG. 1 the housing 1 is open on top and may be closed by means of a cover 2. The housing 1 encases a magnetic coil 3 and a magnetic yoke 4. An angled magnetic armature 5 is supported tiltingly on the magnetic yoke 4, said magnetic armature, by means of a projection 13, a switch spring 7 mounted on a support 6, so that when a voltage is applied to the magnetic coil 3, the switch spring 7 lifts off the contact 8 and contacts the contact 9. For the purpose of the tilting mounting of the magnetic armature 5 on the magnetic yoke 3, a bent, flat spring strip 10 (FIG. 3), made of a synthetic material, is inserted into the housing 1. The spring strip 10 in this example is supported with one end 10' abutting the wall 1' and with its other end 10'' on the support 6, while the concave side of the apex 10''' rests under prestress and free of torque on the armature 5. The spring strip 10 abuts for the purpose of axial fixation with the front side of the end 10' against the lower corner area of the wall 1' and with the other end against a shoulder 15 of the cover 2.

FIG. 2 shows a relay with a circumferentially closed housing 1. In the housing 1, there are again contained, from one side, the magnetic coil 3 with the magnetic yoke 4, the magnetic armature 5, contact spring 7, and contacts 8, 9. In this relay also a bent, flat spring strip 10 is used, which, however, in this case is supported at its ends. The spring strip 10 may thereby rest with its ends 10', 10'' on the walls 1' and 1'' or may be engaged in slits 11 and may be locked, for example unilaterally, in said slits 11.

In the relay of FIG. 4, a spring strip 10 of greater length is provided on the magnetic yoke 4 for the tiltable fastening of the magnetic armature 5, said spring strip extending into the space between the magnetic armature 5 and the switch spring 7 and abutting the switch spring 7 and the support 6 for the switch spring 7, and/or a contact support, respectively. The spring strip 10, in addition to its function as the holding member for the magnetic armature 5, acts with its end 10'' as an insulating layer to separate electrically the magnetic armature and the switch springs. When the magnetic armature 5 is tilted, in the example of FIG. 4, the end 10'' of the spring strip 10 is bent by means of the actuating tappet 13 and the switch spring 7 is thus actuated.

In the relay of FIG. 5, the end 10'' projects into the space between the switch spring 7 and the magnetic armature 5 and abuts the switch spring support 6 and the switch spring 7. The magnetic armature 5 in this relay has a projection 5', which acts to actuate the switch spring 7 by way of the end 10'', when the magnetic coil 3 is energized. In the relay of FIG. 5, the actuating tappet is eliminated. In the area between the switch spring 7, the end 10'' of the spring strip 10 (FIG. 6) is provided with a slit 14, into which a shoulder integral with the cover, projects. By supporting the outlining surfaces 14' on the shoulder 15, the spring strip 10 is immobilized in the housing 1.

We claim:

1. Magnetic armature mounting, in particular for minicompact relays having a housing encasing a magnetic coil, a magnetic yoke, a magnetic armature and a contact spring and wherein the magnetic armature is generally L-shaped and is held with its inside angle tiltably positioned against an edge of the yoke, the improvement comprising: a bent, flat spring strip in said housing, said spring strip abutting under at one end against one of the walls of the housing, and at another end against means in said housing, and with the concave side of its bent apex bearing against the magnetic armature opposite said inside angle to thereby hold said armature tiltably against said yoke without applying torque thereto.

2. Magnetic armature mounting according to claim 1, wherein the spring strip consists of an elastic synthetic material.

3. Magnetic armature mounting according to claim 1, wherein the spring strip is made of a metallic material.

4. Magnetic armature mounting according to claim 1, wherein the spring strip is guided in a slit of the housing wall.

5. Magnetic armature mounting according to claim 1, wherein the spring strip is axially immobilized by supporting it on shoulders on the walls of the housing.

6. Magnetic armature mounting according to claim 1, wherein the housing is closed with a separate cover, the spring strip being supported for axial immobilization with one end against a wall of the housing and with the other end against a projection or the like, secured to the cover.

7. An armature mounting as defined in claim 1 wherein said other end of said spring strip projects into the path of movement of a portion of said armature and is flexed thereby upon tilting movement of said armature.

8. Magnetic armature mounting according to claim 7, wherein the spring strip projects with its end abutting the switch spring into the rotating path of the magnetic armature and that said end of the spring strip may be flexed by the magnetic armature.

9. Magnetic armature mounting according to claim 7 or 8, wherein an end of the spring strip has a slit with an end surface of said slit abutting a shoulder fixed relative to the housing whereby the spring strip is immobilized.

* * * * *